US005683289A

United States Patent [19]

Hempel, Jr.

[11] Patent Number: 5,683,289

[45] Date of Patent: Nov. 4, 1997

[54] CMP POLISHING PAD CONDITIONING APPARATUS

[75] Inventor: Eugene O. Hempel, Jr., Garland, Tex.

[73] Assignee: Texas Instruments Incorporated, Dallas, Tex.

[21] Appl. No.: 670,078

[22] Filed: Jun. 26, 1996

[51] Int. Cl.[6] ..... B24B 53/00

[52] U.S. Cl. ..... 451/56; 451/443

[58] Field of Search ..... 451/56, 72, 443, 451/444

[56] References Cited

U.S. PATENT DOCUMENTS

| | | | |
|---|---|---|---|
| 5,456,627 | 10/1995 | Jackson et al. | 451/56 |
| 5,486,131 | 1/1996 | Cesna et al. | 451/444 |
| 5,531,635 | 7/1996 | Mogli et al. | 451/72 |

FOREIGN PATENT DOCUMENTS

| | | | |
|---|---|---|---|
| 7149158 | 9/1982 | Japan | 451/72 |

*Primary Examiner*—Robert A. Rose

*Attorney, Agent, or Firm*—W. James Brady, III; Richard L. Donaldson

[57] ABSTRACT

A conditioning end effector apparatus (10) for conditioning a CMP polish pad (40) includes an end effector (20) for contacting CMP polish pad (40). Holder mechanism (12) includes end effector recess (18) for receiving end effector (20). Spacer mechanism (22 or 22') is also located at predetermined locations in end effector recess (18) to associate with end effector openings (26) in end effector (20). End effector (20) firmly attaches through spacer mechanism (22 or 22') to holder mechanism (12) using a fastening device (24). Because of spacer mechanism (22 or 22'), end effector (20) is at distance from recess face (36) to permit slurry (38) that is deposited on CMP polish pad (40) to pass through end effector openings (26).

20 Claims, 4 Drawing Sheets

FIG. 4
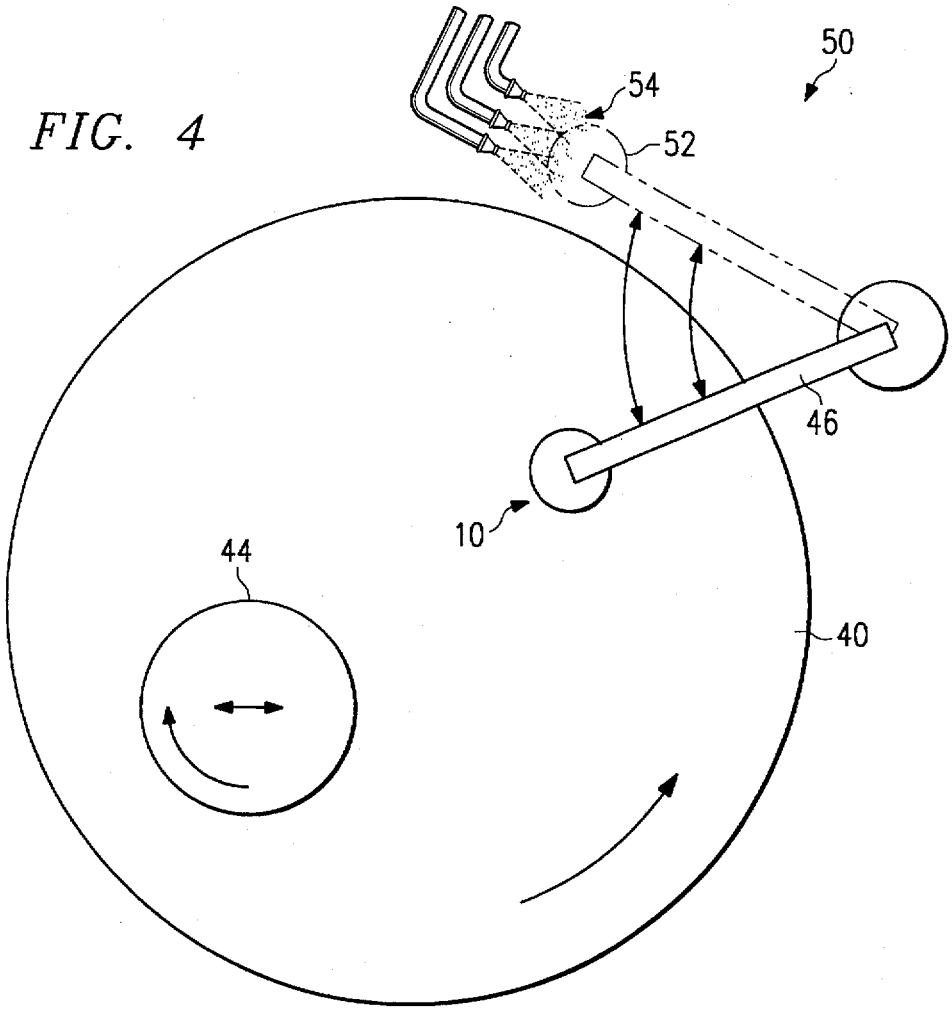
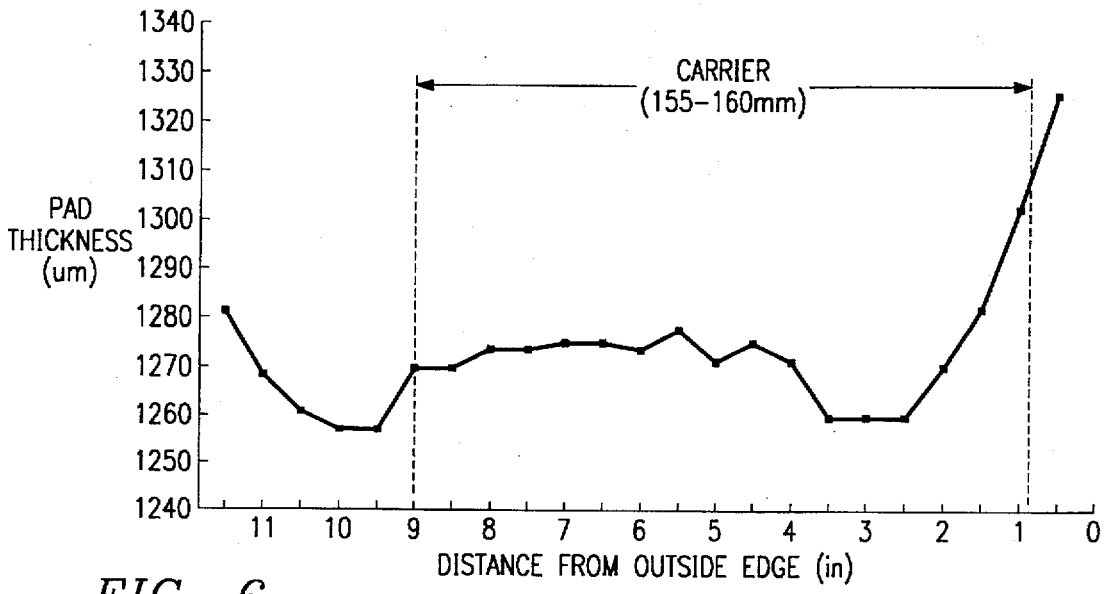
FIG. 6

CM P POLISHING PAD CONDITIONING APPARATUS

TECHNICAL FIELD OF THE INVENTION

The present invention relates to a method and system for processing a semiconductor device and, more particularly, to an improved conditioning mechanism for conditioning chemical mechanical polish (CMP) pad of a CMP machine.

BACKGROUND OF THE INVENTION

Advances in electronic devices generally include reducing the size of the components that form integrated circuits. With smaller circuit components, the value of each unit area of a semiconductor wafer becomes higher. This is because the ability to use all of the wafer area for integrated circuit components improves. To properly form an integrated circuit that employs a much higher percentage of usable wafer area, it is critical that contaminant particle counts on the semiconductor wafer surface be reduced below levels which previously may have been acceptable. For example, minute particles of oxides and metals of less than 0.2 microns are unacceptable for many of the popular advanced circuit designs, because they can short out two or more conducting lines. In order to clean a semiconductor wafer and to remove unwanted particles, chemical mechanical polishing or chemical mechanical polish (hereinafter "CMP") process has become popular.

CMP is a process for improving the surface planarity of a semiconductor wafer and involves the use of mechanical pad polishing systems usually with a silica-based slurry. CMP offers a practical approach for achieving the important advantage of global wafer planarity. However, CMP systems for global planarization have certain limitations.

CMP systems place a semiconductor wafer in contact with a polishing pad that rotates relative to the semiconductor wafer. The semiconductor wafer may be stationary, or it may also rotate on a carrier that holds the wafer. Problems of conventional methods of performing a chemical mechanical polish is that they produce nonuniform wafers and produce larger than desirable edge exclusion areas. Both of these problems impair operation of resulting electronic components formed from the semiconductor devices. Semiconductor wafer non-uniformity may cause undesirable layers not to be removed at some places and desirable layers to be removed at other places on the wafer surface. This causes various areas on the wafer surface to be unusable for forming semiconductor devices. Process uniformity from wafer to wafer is also important in CMP processing. Known CMP systems, however, suffer from significant wafer-to-wafer non-uniformities. This can also adversely affect the throughput and yield of the CMP process.

Another limitation of existing CMP systems relates to a part of the system known as the CMP polish pad. The CMP polish pad contacts the semiconductor wafer and polishes the wafer. A slurry is usually applied to the CMP polish pad to lubricate the interface between the wafer and the CMP polish pad. The slurry also serves the function, because of its silica content, of mildly abrading or affecting the surface of the semiconductor wafer.

A problem that often occurs with these particles and the slurry within the cell structure of the pad is a densification of the slurry within the voids. To overcome this problem, most CMP systems use a CMP polish pad conditioner that includes a diamond-encrusted end effector that rakes or scratches the pad surface. This scratching removes the slurry within the pad cellular structure to, in effect, "renew" the CMP polish pad surface.

A problem of conventional CMP polish pad conditioning end effectors is detaching from the end effector holder mechanism. Known systems typically attach the end effector using a double-sided tape or film that sticks to both the end effector and a surface of an end effector holding mechanism. When the end effector detaches from the double-sided tape, it remains on the CMP polish pad and often damages the semiconductor device.

Another problem of known CMP polish pad conditioning mechanisms is that slurry and semiconductor device particles often form deposits that clog in openings of the end effector. These deposits adversely affect the conditioning operation and limit the usable life span of both the CMP polish pad and the end effector.

Still another problem of existing end effectors is that they wear unevenly due to slurry deposits and an uneven surface that develops on the end effector, due primarily to an uneven interface that develops between the end effector and the holder mechanism.

SUMMARY OF THE INVENTION

Therefore, a need has arisen for improved method and apparatus for conditioning a CMP polish pad.

There is a need for a CMP polish pad conditioning end effector that remains in position during the polish pad conditioning operation and does not detach from the end effector holder.

There is a further need for a CMP polish pad conditioning end effector that avoids the formation of slurry deposits.

There is yet a further need for an improved CMP polish pad conditioning end effector that maintains a more uniform surface after numerous polish operations.

Still a further need for an improved CMP polish pad conditioning end effector that prolongs the life of the conditioned CMP polish pad by more uniformly conditioning the pad and eliminating areas of uneven wear.

In accordance with the present invention, a method and apparatus for conditioning a CMP polish pad is provided that substantially eliminates or reduces disadvantages and problems associated with previously developed CMP polish pad conditioning mechanisms.

More specifically, the present invention provides a method for conditioning a CMP polish pad that includes the steps of placing a spacer mechanism (such as a plurality of separate or individual spacers or a spacer ring) in at least one predetermined location of a end effector holder mechanism. The method places the spacer mechanism in an end effector recess of the holder mechanism in positions that associate with openings in the end effector. The end effector attaches through the spacer mechanism to the holder mechanism using a fastening device such as a screw or pin. The method further includes the steps of conditioning the CMP polish pad by placing the end effector in contact with a CMP polish pad having a layer of slurry deposited on the CMP polish pad for conditioning the CMP polish pad while the slurry passes through the end effector openings.

Another aspect of the present invention is an apparatus for conditioning a CMP polish pad that includes an end effector for contacting the CMP polish pad. A holder mechanism includes an end effector recess for receiving the end effector. The spacer mechanism is also located in at least one predetermined location in the end effector recess. The spacer opening locations associate with end effector openings in the end effector. The end effector firmly attaches through the spacer mechanism to the holder mechanism using a fastening device such as a screw or pin. Because of the spacer mechanism, the end effector is at a distance from the holder mechanism that permits slurry deposited on the CMP polish pad to pass through the end effector openings.

A technical advantage of the present invention is it overcomes the problem of conventional polish pad conditioner end effectors. Because the end effectors firmly fastens to the holder mechanism through the spacer mechanism, there is not the possibility of the end effector detaching from the conditioning end effector holder.

Another technical advantage that the present invention provides is a practical solution to the problem slurry and semiconductor device particles forming deposits in openings of the end effector. The CMP polish pad end effector of the present invention permits complete flushing of the end effector openings. This cleans out potential slurry and particle deposits from the end effector openings. The result is an always fresh and clean end effector surface for conditioning the CMP polish pad.

Yet another technical advantage of the present invention it solves the problem of existing end effectors of wearing unevenly due to slurry deposits and an uneven interface that develops between the end effector and the holder mechanism. The present invention rigidly and securely mounts the end effector to the holder mechanism. This differs from the compliant tape or film that conventional conditioners use. Because of the rigid mounting of the end effector, together with the elimination of slurry and particle deposits, more even wear of the end effector, and more uniform conditioning of the CMP polish pad results.

BRIEF DESCRIPTION OF THE DRAWINGS

For a more complete understanding of the present invention and the advantages thereof, reference is now made to the following description which is to be taken in conjunction with the accompanying drawings in which like reference numerals indicate like features and wherein:

FIG. 4 shows an application of the present embodiment in a CMP process;

FIGS. 5 and 6 provide plots of a CMP polish pad thicknesses after numerous conditioning operations to show further benefits of the apparatus of the present embodiment.

DETAILED DESCRIPTION OF THE INVENTION

Preferred embodiments of the present invention are illustrated in the FIGUREs like numerals being used to refer to like and corresponding parts of the various drawings.

Figure 1:
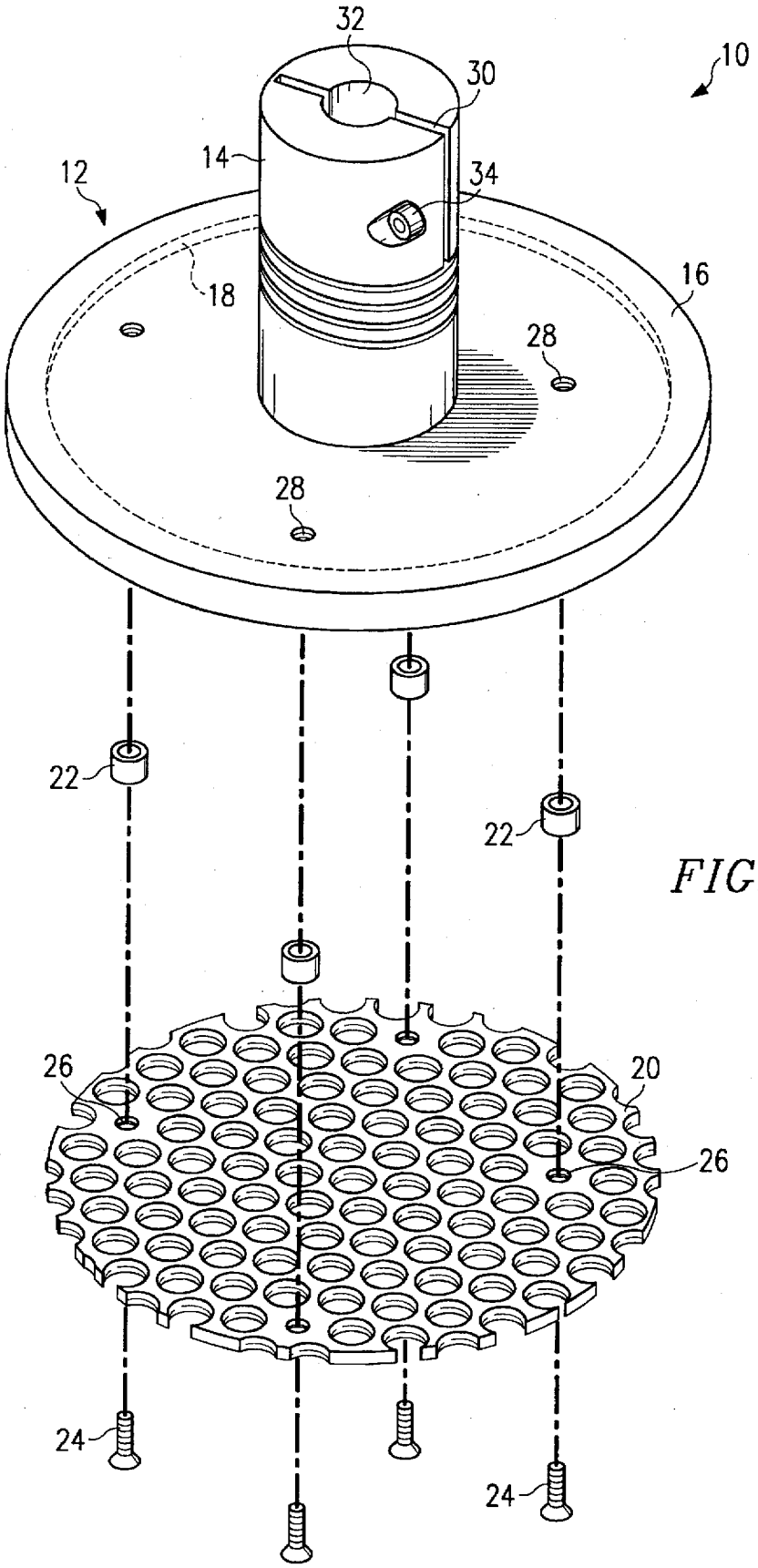
FIGS. 1 and 1A illustrate an exploded view of one embodiment of the present invention.
Figure 1A:
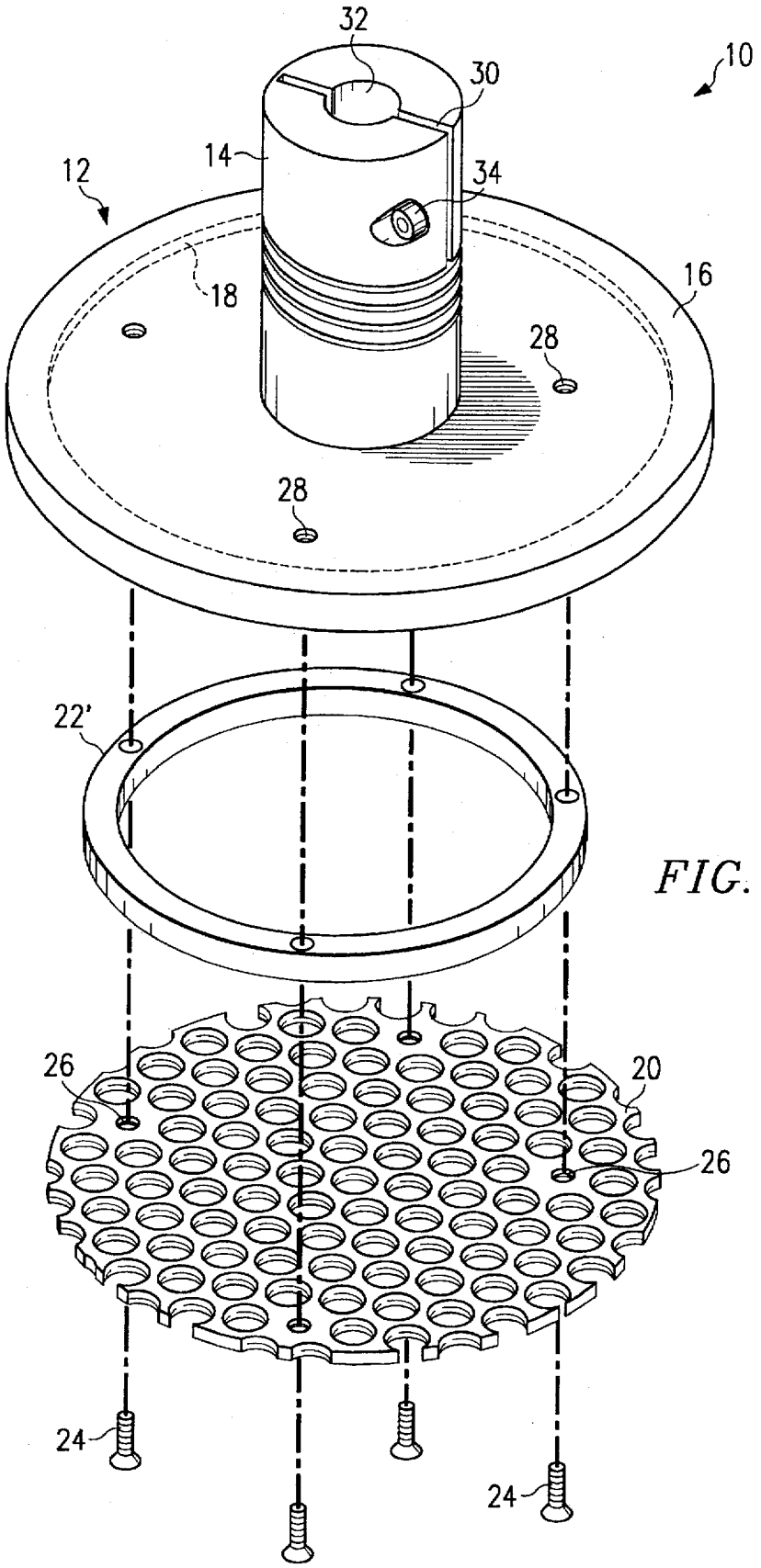

FIGS. 1 and 1A show an exploded view of conditioning end effector apparatus 10 that includes holder mechanism 12. Holder mechanism 12 includes shaft 14 and base 16. Base 16 includes end effector recess 18 for receiving end effector 20. The spacer mechanism for the present embodiment may be spacers 22 fit in end effector recess 18 and evenly space end effector 20 from the face of recess 18. Instead of using a plurality of spacers the spacer mechanism may be a spacer ring 22' may be useful to separate end effector 20 from the face of recess 18. FIG. 1A shows this alternative embodiment. Referring simultaneously to FIGS. 1 and 1A, therefore, screws 24 pass through opening 26 of end effector 20 and fasten in screw holes 28 of base 16. FIGS. 1 and 1A also show slot 30 and hole 32 in shaft 14 for receiving a robotic arm of an associated CMP system for holding conditioning end effector apparatus 10. Set screw 34 comprises slot 30 to the robotic arm to attach end effector apparatus 10 to the robotic arm.

Figure 2:
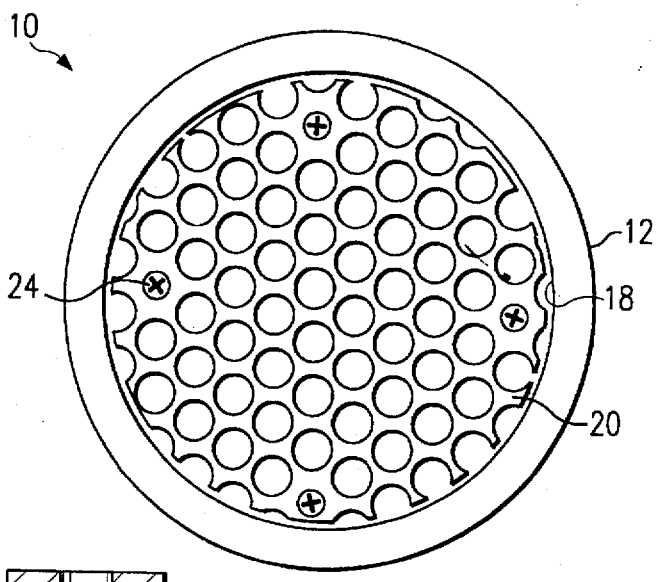
FIG. 2 shows a facial view of the end effector of the present embodiment.
Figure 3:
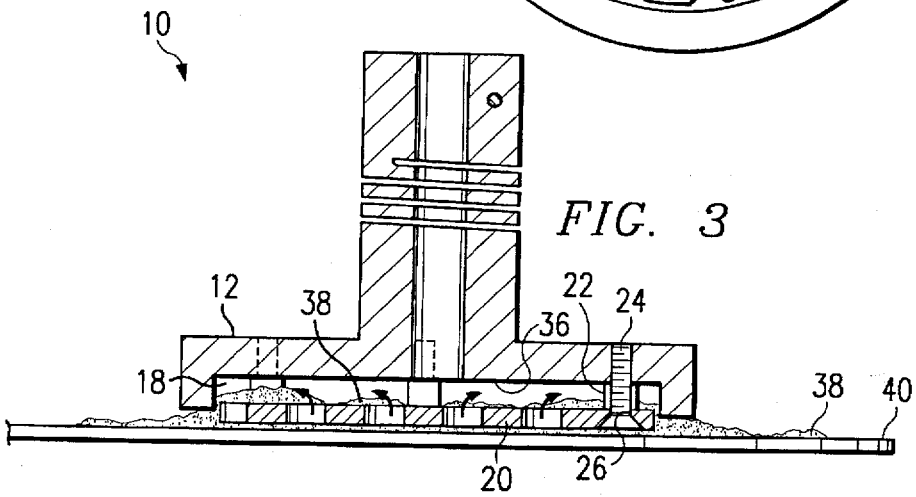
FIG. 3 shows a cut-away view of the conditioning end effector apparatus of the present embodiment.

FIG. 2 shows a face view of conditioning end effector apparatus 10 including the bottom face of holder mechanism 12 and end effector 20 positioned within recess 18. End effector 20 is of stainless steel construction and includes a diamond-encrusted surface. The diamond-encrusted surface may be formed by any of a variety of known encrusting or layering techniques. As FIG. 2 illustrates, screws 24 hold end effector 20 firmly in place within recess 18. Screws 24 in end effector 20 are recessed within holes 26 so that they do not contact CMP polish pad 40 when end effector 20 contacts CMP polish pad FIG. 3 shows a cut-away side view of conditioning end effector apparatus 10 of the present embodiment. In FIG. 3, holder mechanism 12 is shown with spacers 22 separating end effector 24 from recess face 36. As FIG. 3 shows, slurry 38 forms a lubricating layer between conditioning end effector 10 and CMP polish pad 40. As conditioning end effector 10 conditions CMP polish pad 40, slurry 38 passes through opening 26 of end effector 20.

FIG. 4 shows a typical operation employing conditioning end effector 10 of the present embodiment. In particular, FIG. 4 shows CMP mechanism 50 that includes polish pad 40 on which carrier device 44 is positioned. Carrier device 44 holds a semiconductor wafer in contact with CMP polish pad 40. As carrier device 44 holds a semiconductor device in contact with CMP polish pad 40, it rotates in a direction opposite the rotation of CMP polish pad 40. To condition CMP polish pad 40, robotic arm 46 places conditioning end effect apparatus in contact with CMP polish pad 40. Robotic arm 46 moves conditioning end effector apparatus 10 back and forth to condition CMP polish pad 40. After conditioning, robotic arm 46 moves conditioning end effector apparatus 10 to home position 52. At home position 52, spray nozzle 54 sprays end effector apparatus 10 with water or another solvent as a cleaning fluid to remove slurry from end effector 20. The preferred embodiment of the invention includes three spray nozzles 54 that may thoroughly clean openings 26 of end effector 20. This promotes complete use of end effector 20 and prolongs the life of the CMP polish pad 40 and end effector 20. Because of the space between end effector 20 and recess face 36, spray nozzles 54 more effectively clean end effector 20.

Figure 5:
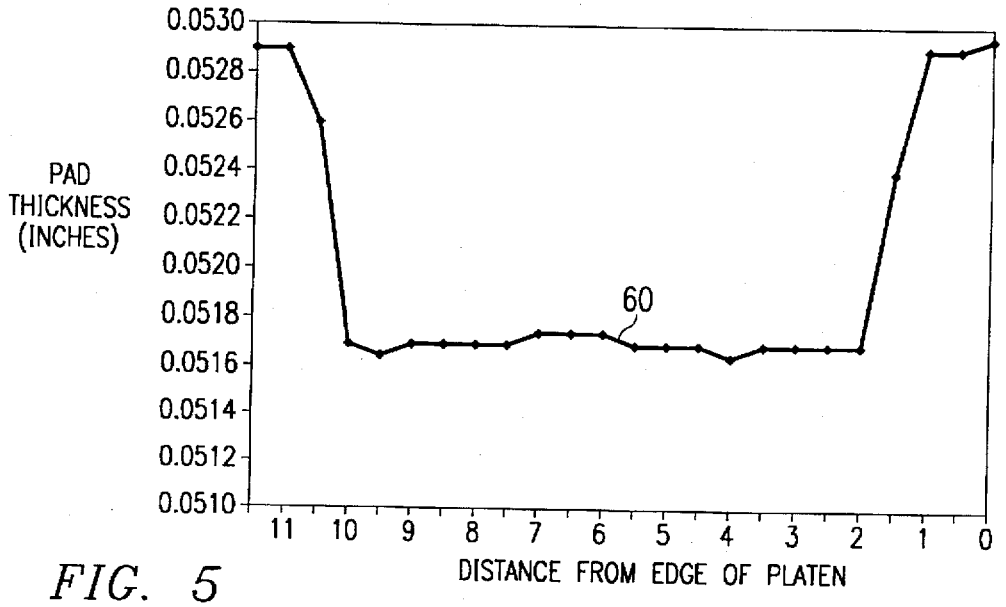

FIGS. 5 and 6 show a particularly important aspect of the present embodiment. FIG. 5 shows the results of using the conditioning end effector apparatus 10 of the present embodiment. FIG. 6 shows results that a conventional conditioning end effector produces. FIG. 5 provides a plot of the CMP polish pad thickness in inches versus distance from the edge of CMP polish pad 40, for example. Referring momentarily to FIG. 4, as robotic arm 46 moves back and forth it creates a path of travel for conditioning end effector apparatus 10. FIG. 5 shows that as a result of the improved structure that the present embodiment provides, a more uniform area of wear 60 results. FIG. 6, on the other hand, shows the rather erratic wearing of the area of CMP polish pad 40 along the path of the conventional conditioning end effector apparatus.

The present embodiment provides the technical advantage of not having end effector 20 separate from holder mechanism 12. A problem with conventional devices is that end effector 20 is held in contact with recess face 368 using a two-sided tape or film. In operation, the two-sided tape loses its grip and end effector 20 separates from holder mechanism 12. The result is that end effector 20 may come in contact with the spinning carrier device 44 to destroy or damage the semiconductor wafer or device being polished.

Another advantage that the present embodiment provides is a more uniform distribution of wear and force as a result of spacers 22. Spacers 22 and fasteners 24 provide a rigid and level foundation for holding end effector 20 that uniformly distributes forces between conditioning end effector apparatus 10 and CMP polish pad 40. In conventional devices, uneven wear results on the diamond-encrusted end effector 20. This produces the uneven wear that FIGS. 5 and 6 show. Moreover, this expends the surface of end effector 20 more rapidly than does the present embodiment. For example, the even wear that FIG. 5 depicts is the result of polishing approximately 450 wafers. To the contrary, the uneven results of FIG. 6 occur only after polishing as many as 150 wafers.

Still another technical advantage that the present embodiment provides includes the spacing of end effector 20 a small distance from recess face 36. This permits slurry to pass through openings 26 of end effector 20. This eliminates slurry and semiconductor particles in openings 26 of end effector 20. This is far superior than the two-sided tape of previous conditioning end effector devices that would cause uneven wear of the diamond encrusted end effector surface.

One possible additional feature of the present embodiment is to assist in the removal of slurry from the end effector apparatus 10 using a means of vibration or agitation. One attractive method of providing a desireable level of agitation is vibrating the end effector using an ultrasonic vibration device. One known such ultrasonic vibration device is an ultrasonic transducer having the name MEGASONIC® ultrasonic transducer. Such an ultrasonic transducer device may be a stationary device that can be attached to the end effector apparatus 10 to dislodge attached slurry for its removal. The ultrasonic transducer device may be located at the rinse station and energized once the water is applied to the end effector at that location. On the other hand, the ultrasonic transducer device may be formed as an integral part of the end effector. The ultrasonic transducer transducer may operate by dialing in the desired frequency and vibration strength, for example, a frequency of 50 MHz (or within a range of frequencies from 40–60 MHz) can be applied to cause the necessary dislodging of the slurry particulate.

Although the invention has been described in detail herein with reference to the illustrative embodiments, it is to be understood that this description is by way of example only and is not to be construed in a limiting sense. It is to be further understood, therefore, that numerous changes in the details of the embodiments of the invention and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A method for conditioning a CMP polish pad, comprising the steps of:

placing a spacer mechansism in at least one predetermined location of a holder mechanism end effector recess;

placing the spacer mechanism in the end effector recess in positions that associate with selected ones of a plurality of end effector openings in the end effector;

attaching the end effector through the spacer mechanism to the holder mechanism using a fastening device; and placing the end effector in contact with a CMP polish pad having a layer of slurry deposited on the CMP polish pad for conditioning the CMP polish pad while the slurry passes through the plurality of end effector openings.

2. The method of claim 1, further comprising the step of flowing a cleaning fluid through the plurality of end effector openings for removing deposits from the end effector.

3. The method of claim 1, further comprising the step of removing deposited slurry from the end effector openings by agitating the plurality of end effector openings.

4. The method of claim 1, further comprising the step of uniformly positioning the spacer mechanism to distribute evenly forces between the end effector and the CMP polish pad.

5. The method of claim 1, further comprising the step of fastening the end effector to the holder mechanism with screw passing through the spacer mechanism.

6. The method of claim 1, further comprising the step of encrusting the end effector surface for conditioning the CMP polish pad.

7. The method of claim 1, further comprising the step of moving the end effector across the CMP polish pad.

8. The method of claim 1, further comprising the step of rotating the holder mechanism and moving the end effector across the CMP polish pad.

9. An apparatus for conditioning a CMP polish pad, comprising:

an end effector for contacting the CMP polish pad;

a holder mechanism comprising an end effector recess for receiving the end effector;

a spacer mechanism located at predetermined locations in said end effector recess to associate with a plurality of end effector openings in said end effector; and a plurality of fastening devices each for passing through said spacer mechanism for attaching said end effector firmly to said holder mechanism.

10. The apparatus of claim 9, further comprising a spraying mechanism for spraying said end effector for flowing a cleaning fluid through the end effector opening for removing deposits from the end effector.

11. The apparatus of claim 9, wherein said spacer mechanism is uniformly positioned for distributing evenly forces between the end effector and the CMP polish pad.

12. The apparatus of claim 9, wherein said plurality of fastening devices comprises a plurality of screws for placement within said end effector openings.

13. The apparatus of claim 9, wherein said end effector comprises a diamond-encrusted surface.

14. The apparatus of claim 9, further comprising a robotic arm for attaching to said holder mechanism for moving the end effector across the CMP polish pad.

15. The apparatus of claim 9, further comprising a robotic arm for attaching to said holder mechanism for moving the end effector across the CMP polish pad.

16. A method for forming an apparatus for conditioning a CMP polish pad, comprising the steps of:

forming an end effector for contacting the CMP polish pad;

forming a holder mechanism comprising an end effector recess for receiving the end effector;

forming a spacer mechanism located at predetermined locations in the end effector recess for associating with end effector openings in the end effector; and forming a fastening device firmly attaching the end effector through the spacer mechanism to the holder mechanism at a distance from the holder mechanism.

17. The system of claim 16, further comprising the step of forming a spraying mechanism for spraying said end effector to flow a cleaning fluid through the end effector opening for removing deposits from the end effector.

18. The system of claim 16, further comprising the step of forming said spacer mechanism such that said spacer mechanism is uniformly positioned for evenly distributing forces between the end effector and the CMP polish pad.

19. The system of claim 16, further comprising the step of forming said plurality of fastening devices such that said plurality of fastening devices comprises a plurality of screws for placement within said end effector openings.

20. The system of claim 16, further comprising the step of forming a robotic arm for attaching to said holder mechanism for moving the end effector across the CMP polish pad.

* * * * *